US009314054B2

(12) United States Patent
Yuasa et al.

(10) Patent No.: US 9,314,054 B2
(45) Date of Patent: Apr. 19, 2016

(54) GARMENT HAVING CUP PART

(71) Applicant: Wacoal Corp., Kyoto (JP)

(72) Inventors: Masaru Yuasa, Kyoto (JP); Megumi Tachiiri, Kyoto (JP); Keiko Ishii, Kyoto (JP); Mariko Kanazawa, Kyoto (JP)

(73) Assignee: Wacoal Corp., Kyoto-shi, Kyoto (JP)

( * ) Notice: Subject to any disclaimer, the term of this patent is extended or adjusted under 35 U.S.C. 154(b) by 0 days.

(21) Appl. No.: 14/037,880

(22) Filed: Sep. 26, 2013

(65) Prior Publication Data

US 2014/0087624 A1 Mar. 27, 2014

(30) Foreign Application Priority Data

Sep. 27, 2012 (JP) ..... P2012-214500

(51) Int. Cl.
*A41C 3/12* (2006.01)

(52) U.S. Cl.
CPC ..... *A41C 3/12* (2013.01); *A41D 2300/50* (2013.01)

(58) Field of Classification Search
CPC ..... A41C 3/00; A41C 3/14; A41C 3/144; A41C 3/148
USPC ..... 450/19–21, 34, 74–76, 53, 92, 44, 59, 450/60, 65, 66
See application file for complete search history.

(56) References Cited

U.S. PATENT DOCUMENTS

| | | | | |
|---|---|---|---|---|
| 2,481,603 | A * | 9/1949 | Lo Cascio | 450/75 |
| 4,444,192 | A * | 4/1984 | Stern et al. | 450/67 |
| 5,045,019 | A * | 9/1991 | Capasso et al. | 450/74 |
| 5,167,566 | A * | 12/1992 | Novitsky et al. | 450/74 |
| 5,823,851 | A * | 10/1998 | Dicker | 450/2 |
| 6,685,534 | B2 * | 2/2004 | Mitchell et al. | 450/74 |
| 6,918,812 | B2 * | 7/2005 | Giese | 450/65 |
| 7,163,432 | B2 * | 1/2007 | Mitchell et al. | 450/65 |
| 8,137,155 | B2 * | 3/2012 | Horii et al. | 450/75 |
| 2003/0082994 | A1 * | 5/2003 | Mitchell et al. | 450/74 |
| 2004/0110447 | A1 * | 6/2004 | Mitchell et al. | 450/75 |
| 2005/0079794 | A1 * | 4/2005 | Giese | 450/65 |
| 2009/0172858 | A1 * | 7/2009 | Oya et al. | 2/69 |

FOREIGN PATENT DOCUMENTS

| | | |
|---|---|---|
| JP | 2006-124890 | 5/2006 |
| JP | 2006-132049 | 5/2006 |

* cited by examiner

*Primary Examiner* — Gloria Hale
(74) *Attorney, Agent, or Firm* — Jeremy Jay

(57) ABSTRACT

A garment 1 having a cup part in accordance with an embodiment of the present invention is a garment having a cup part for covering a bust. The cup part 10 has upper and lower cup portions 12, 16, with a middle cup portion 14 sewed therebetween. The middle cup portion 14 is arranged such that a bust top T is located at a boundary between the upper and middle cup portions 12, 14 or in the middle cup portion 14 and extends from a front center side edge 10*lf* of a lower portion or a front center side edge of an upper portion of the cup part 10 to an outer side edge of the lower portion, an edge 10*s* of a side portion, or an outer side edge of the upper portion thereof.

4 Claims, 7 Drawing Sheets

(a)

(b)

(c)

(a)

(b)

(c)

GARMENT HAVING CUP PART

BACKGROUND OF THE INVENTION

1. Field of the Invention

The present invention relates to a garment having a cup part for covering a bust (a breast).

2. Related Background Art

An example of garments having a cup part for covering the bust is a brassiere. For fitting the round form of the bust, the cup part of the brassiere is formed three-dimensionally by sewing (patching) three fabric sheets together so as to yield a substantially T-shaped seam (which will hereinafter be referred to as T-shaped three-sheet sewing) as illustrated in FIG. 7, for example. Specifically, a T-shaped three-sheet-sewed cup part 10X is formed by sewing a fabric 14X adapted to cover the front center side of the lower side of a bust top (a breast top, a breast tip, or a nipple) T when worn and a fabric 16X adapted to cover the outer side of the lower side of the bust top T when worn to each other so as to yield a vertical seam and further sewing thus vertically sewed fabrics and a fabric 12X adapted to cover the upper side of the bust top T together so as to yield a transversal seam.

Patent Literatures 1 and 2 disclose a brassiere having a cup part formed by sewing four fabric sheets together. The cup part of the brassiere disclosed in Patent Literatures 1 and 2 is formed by sewing another fabric sheet between the fabric on the front center side of the lower side and the fabric on the outer side of the lower side in the above-mentioned T-shaped three-sheet-sewed cup part so as to yield a vertical seam.

Patent Literature 1: Japanese Patent Application Laid-Open No. 2006-124890

Patent Literature 2: Japanese Patent Application Laid-Open No. 2006-132049

SUMMARY OF THE INVENTION

Meanwhile a garment having a cup part is desired to enhance the bust shaping property, in particular, to exhibit a deep cleavage between the left and right breasts and round bust tops.

It is therefore an object of the present invention to provide a garment having a cup part which can enhance the bust shaping property.

The inventors have found that transversally sewed cup parts having transversal seams fit the round form of the bust better than vertically sewed cup parts having vertical seams, thereby being able to enhance the bust shaping property, in particular, deepen the cleavage between the left and right breasts and round the bust tops.

Hence, the present invention provides a garment having a cup part for covering a bust, the cup part having an upper cup portion and a lower cup portion, with a middle cup portion sewed therebetween, the middle cup portion being arranged such that a bust top is located at a boundary between the upper cup portion and the middle cup portion or in the middle cup portion and extending from a front center side edge of a lower portion or a front center side edge of an upper portion of the cup part to an outer side edge of the lower portion, an edge of a side portion, or an outer side edge of the upper portion thereof.

This garment has a cup part which is a transversal three-sheet-sewed cup part constituted by upper, middle, and lower cup portions and thus can enhance the fitness of the cup part for the bust having a round form, thereby enhancing the bust shaping property. In particular, it can deepen the cleavage between the left and right breasts and round the bust tops.

The high bust shaping property and the high fitness of the cup part for the bust enable the cup part to rest stably on the bust, thereby inhibiting the cup part from shifting from the bust, in particular, the upper portion of the cup part from floating or biting that occurs as a result of the wearer's movement.

In the middle cup portion, a front center side end portion may have a width greater than that of an outer side end portion thereof. In this structure, the front center side end portion of the middle cup portion has a greater width and thus can favorably fit the round form of the bust, thereby enhancing the bust shaping property.

In the middle cup portion, the outer side end portion may have a width greater than that of the front center side end portion thereof. In this structure, the outer side end portion of the middle cup portion has a greater width and thus can favorably fit the round form of the bust, thereby enhancing the bust shaping property. The middle cup portion can also enhance a gathering effect.

In the middle cup portion, each of the front center side end portion and the outer side end portion may have a width equal to that of a center portion. In this structure, the middle cup portion has a large width from the front center side end portion to the outer side end portion and thus can more favorably fit the round form of the bust, thereby enhancing the bust shaping property. The middle cup portion can also enhance the gathering effect. Further, when sewing the middle cup portion, the front center side end portion and the outer side end portion of the middle cup portion are easier to support, which facilitates a manufacture process.

As explained in the foregoing, the present invention can enhance the bust shaping property. In particular, it can deepen the cleavage between the left and right breasts and round the bust tops.

The high bust shaping property and the high fitness of the cup part for the bust enable the cup part to rest stably on the bust, thereby inhibiting the cup part from shifting from the bust, in particular, the upper portion of the cup part from floating or biting that occurs as a result of the wearer's movement.

DESCRIPTION OF THE PREFERRED EMBODIMENTS

Figure 1:
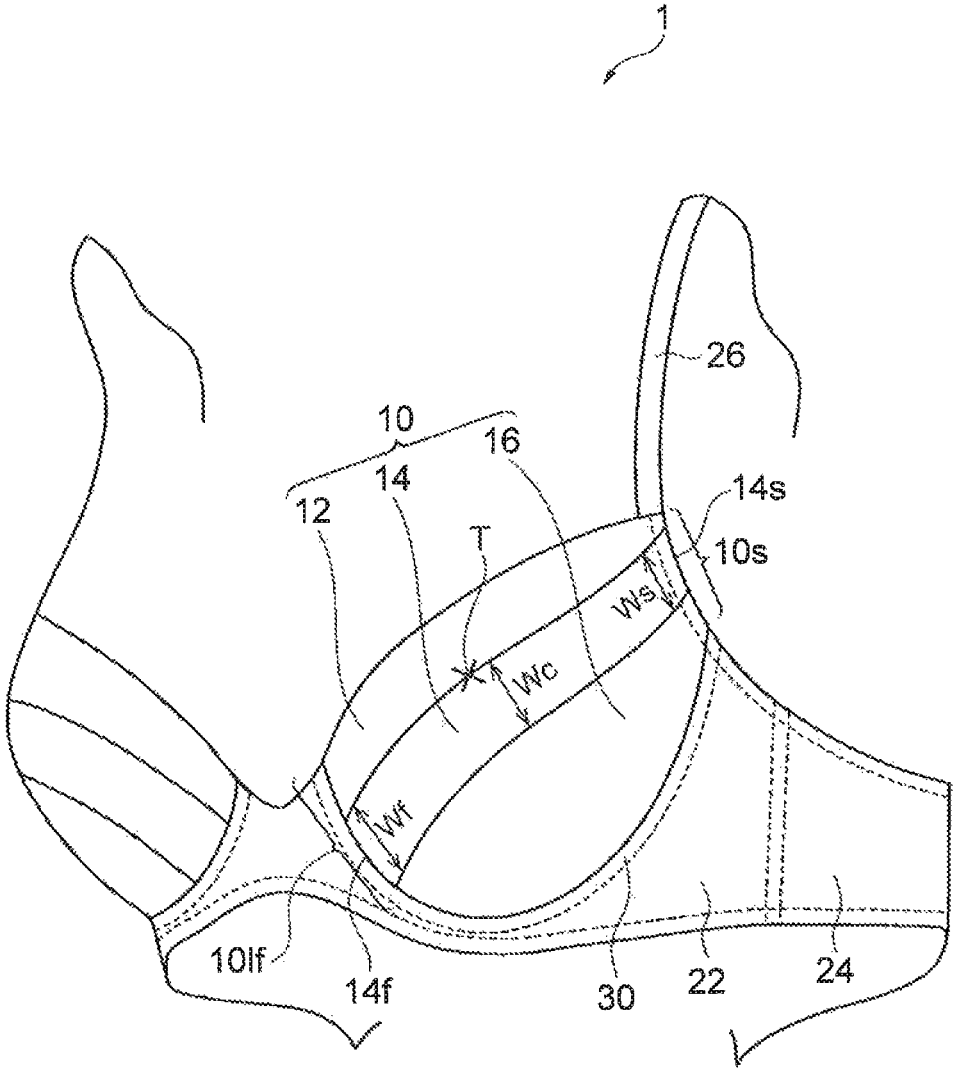
FIG. 1 is a perspective view illustrating the brassiere in accordance with a first embodiment of the present invention.

In the following, preferred embodiments of the garment having a cup part in accordance with the present invention will be explained in detail with reference to the drawings. In the drawings, the same or equivalent parts will be referred to with the same signs.

First Embodiment

FIG. 1 is a perspective view illustrating the brassiere in accordance with the first embodiment of the present invention. The brassiere 1 of the first embodiment comprises cup parts 10, a base part 22, back belt parts 24, and shoulder strap parts 26. Since the brassiere 1 is substantially bilaterally symmetric, only one of the left and right halves thereof will be explained in the following.

The cup part 10, which is used for covering the bust, is supported by the base part 22. The base part 22 is made of a non-elastic fabric and sewn to a lower portion of the cup part 10. The back belt part 24 is sewn to an outer side (frank side, lateral side) of the base part 22. The back belt part 24, which is made of an elastic fabric, is joinable to its counterpart on the back in order to support the base part 22 and cup part 10. The shoulder strap part 26 is sewn to the outer side of the upper portion of the cup part 10. The shoulder strap 26 is made of an elastic tape material and joined to the back belt part 24 over a shoulder in order to support the cup part 10.

A tape member is sewn along a verge line to the rear side (skin side) of the boundary between the cup part 10 and the base part 22 and loaded with an underwire 30 on the inside. The underwire 30 is not always necessary. An elastic tape member is sewn to the rear side of the lower portion of the base part 22, the rear side of the lower portion of the back belt part 24, and the rear side of the joint between the base part 22 and the back belt part 24. An elastic tape member is also sewn to the rear side from the side portion (frank portion, lateral portion) of the cup part 10 to the upper portion of the back belt part 24 through the upper portion of the base part 22.

The cup part 10 will now be explained in detail. The cup part 10 has an upper cup portion 12, a middle cup portion 14, and a lower cup portion 16. The upper cup portion 12, middle cup portion 14, and lower cup portion 16 are made of non-elastic fabrics, for example. Each of the middle and lower cup portions 14, 16 may comprise a layer of polyurethane or the like held between two layers of a fabric so as to have a thickness and flexibility.

The middle cup portion 14 is sewed between the upper and lower cup portions 12, 16. Specifically, the upper and middle cup portions 12, 14 are arranged such that a bust top T is designed to be positioned at their boundary and, when worn, is located at the boundary or in the middle cup portion 14, while the lower portion of the upper cup portion 12 and the upper portion of the middle cup portion 14 are sewed to each other. The lower cup portion 16 is arranged on the lower side of the middle cup portion 14, while the lower portion of the middle cup portion 14 and the upper portion of the lower cup portion 16 are sewed to each other.

The middle cup portion 14 is formed into a band extending substantially linearly from a front center side edge (front center side fringe) 10*lf* of a lower portion of the cup part 10 to an edge (fringe) 10*s* of a side portion thereof through near the bust top T. The middle cup portion 14 has substantially the same width from a front center side end portion 14*f* to an outer side end portion (frank side end portion, lateral side end portion) 14*s*. That is, in the middle cup portion 14, each of the width Wf of the front center side end portion 14*f* and the width Ws of the outer side end portion 14*s* is substantially equal to the width We at the center portion. Thus, the cup part 10 forms a transversal three-sheet-sewed cup part having transversal seams.

The middle cup portion 14 is thicker than each of the upper and lower cup portions 12, 16. This enables the middle cup portion 14 to have a push-up force stronger than that of any of the upper and lower cup portions 12, 16.

Figure 7:
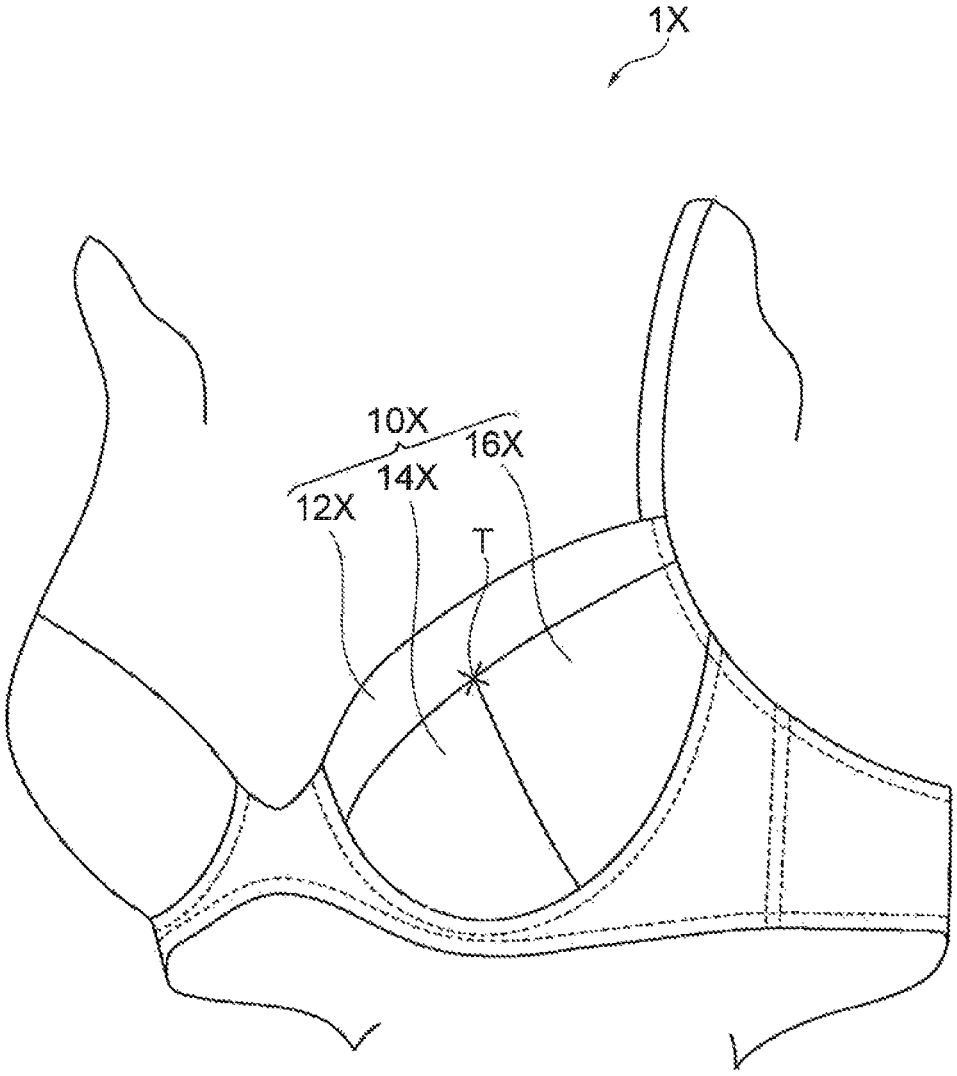
FIG. 7 is a perspective view illustrating a conventional brassiere.

As illustrated in FIG. 7, for example, a cup part 10X of a conventional brassiere 1X is formed three-dimensionally by sewing three sheets of fabrics 12X, 14X, 16X together so as to yield a substantially T-shaped seam (which will hereinafter be referred to as T-shaped three-sheet sewing) in order to fit the round form of the bust. Specifically, the T-shaped three-sheet-sewed cup part 10X is formed by sewing the fabric 14X adapted to cover the front center side of the lower side of the bust top T when worn and the fabric 16X adapted to cover the outer side of the lower side of the bust top T when worn to each other so as to yield a vertical seam and further sewing thus vertically sewed fabrics 14X, 16X and the fabric 12X adapted to cover the upper side of the bust top T together so as to yield a transversal seam.

However, the inventors have found that transversally sewed cup parts having transversal seams can, fit the round form of the bust better than vertically sewed cup parts having vertical seams, thereby enhancing the bust shaping property, in particular, deepening the cleavage between the left and right breasts and rounding the bust tops.

Since the cup part 10 is a transversal three-sheet-sewed cup part constituted by the upper, middle, and lower cup portions 12, 14, 16, the brassiere 1 in accordance with the first embodiment can enhance the fitness of the cup part 10 for the bust having a round form, thereby enhancing the bust shaping property. In particular, it can deepen the cleavage between the left and right breasts and round the bust tops.

In particular, the brassiere 1 of the first embodiment is suitable for round hard busts whose volumes are difficult to move, which are often seen in females in their later teens and early twenties.

For enhancing the bust shaping (gathering and raising) property of this kind of round hard busts whose volumes are difficult to move, pushing up the vicinity of the bust top T is effective. In the brassiere 1 of the first embodiment, the middle cup portion 14 in the cup part 10 is located near the bust top T and has a bust push-up force stronger than that of any of the upper and lower cup portions 12, 16, thus being able to push up the vicinity of the bust top T. Hence, the brassiere 1 of the first embodiment can enhance the shaping property for busts which are so hard that their volumes are difficult to move.

Because of the high bust shaping property and the high fitness of the cup part 10 for the bust as mentioned above, the brassiere 1 of the first embodiment enables the cup part 10 to rest stably on the bust, thereby inhibiting the cup part 10 from shifting from the bust, in particular, the upper portion of the cup part 10 from floating or biting that occurs as a result of the wearer's movement.

Widening the middle cup portion 14 from the front center side end portion 14*f* to the outer side end portion 14*s* as in this structure enables the cup part 10 to fit the round form of the bust favorably, thereby enhancing the bust shaping property. It can also enhance the gathering effect produced by the middle cup portion 14. Further, when sowing the middle cup portion 14, the front center side end portion and outer side end portion of the middle cup portion 14 are easier to support, which facilitates a manufacture process.

First Modified Example of First Embodiment

Figure 2:
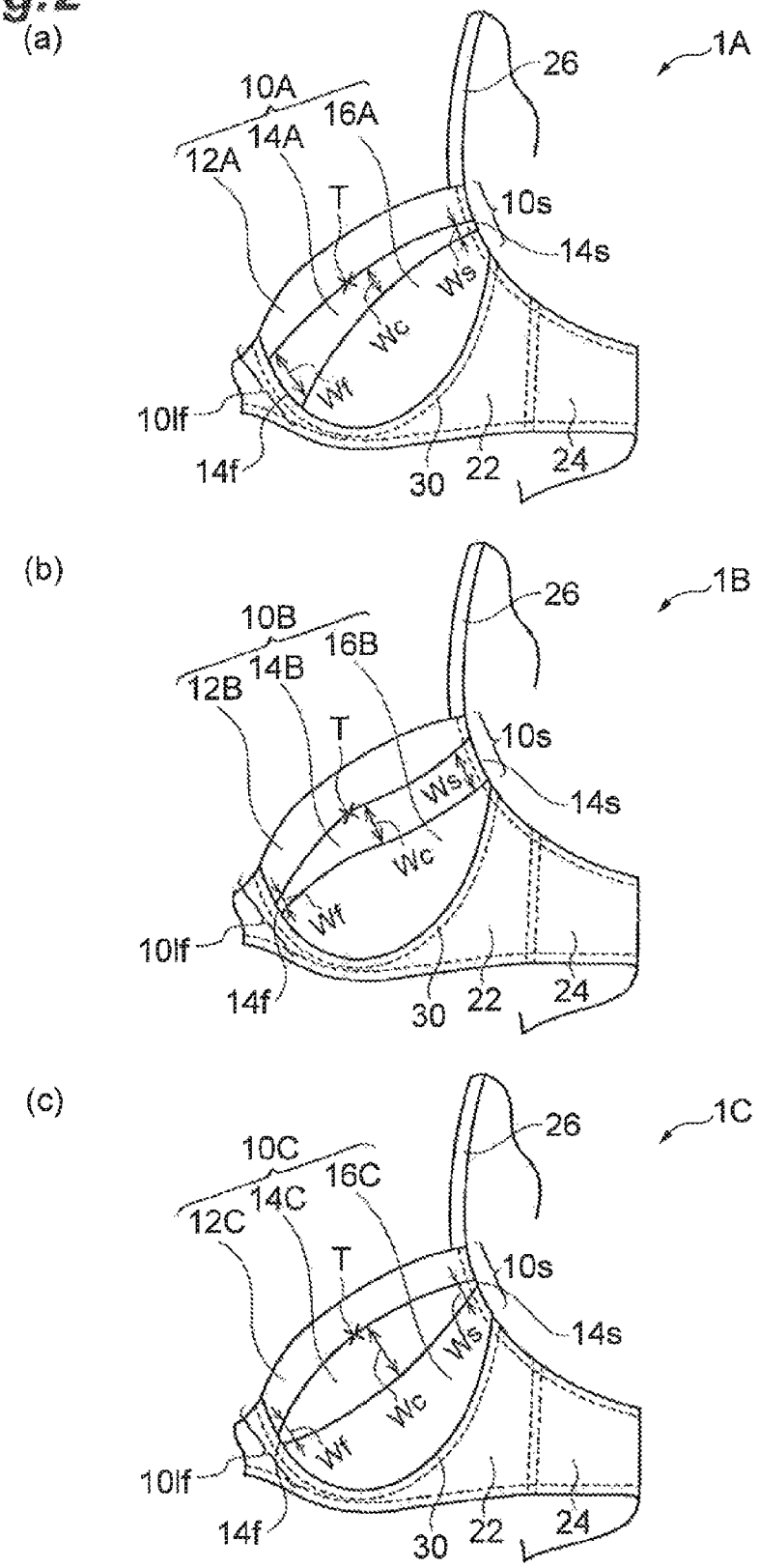
FIGS. 2(*a*) to 2(*c*) are diagrams illustrating one of the left and right halves of respective brassieres in accordance with first, second, and third modified examples of the first embodiment of the present invention.

FIG. 2(*a*) is a diagram illustrating one of the left and right halves of the brassiere in accordance with a first modified example of the first embodiment of the present invention. The brassiere 1A in accordance with the first modified example differs from the first embodiment in that it comprises a cup part 10A in place of the cup part 10 in the brassiere 1. Except for this point, the brassiere 1A of the first modified example is constructed as with the brassiere 1 of the first embodiment.

The cup part 10A differs from the cup part 10 in that each part of its middle cup portion 14A has a width different from that of the middle cup portion 14. Specifically, the width of the middle cup portion 14A gradually increases from the outer side end portion 14*s* to the front center side end portion 14*f*. That is, in the middle cup portion 14A, the width Wf of the front center side end portion 14*f* is greater than the width Wc of the center portion, which is greater than the width Ws of the outer side end portion 14*s*. The outer side end portion 14*s* in the middle cup portion 14A is preferably in contact with the edge 10*s* of the side portion of the cup part 10A, and the present invention encompasses a mode in which the width Ws is as narrow as possible so as to become a point.

Except for the above, the cup part 10A is constructed as with the cup part 10. That is, the cup part 10A has an upper cup portion 12A, a middle cup portion 14A, and a lower cup portion 16A, while the middle cup portion 14A is sewed between the upper and lower cup portions 12A, 16A. The middle cup portion 14A is arranged such that the bust top T is designed to be positioned at the boundary between the upper and middle cup portions 12A, 14A and, when worn, is located at the boundary or in the middle cup portion 14A. The middle cup portion 14A is formed into a band extending substantially linearly from the front center side edge 10*lf* of the lower portion of the cup part 10A to the edge 10*s* of the side portion thereof through near the bust top T.

The brassiere 1A of the first modified example has advantages similar to those of the brassiere 1 of the first embodiment.

Widening the width Wf of the front center side end portion 14*f* of the middle cup portion 14A as in this structure enables the cup part to fit the round form of the bust favorably, thereby enhancing the bust shaping property.

Second Modified Example of First Embodiment

FIG. 2(*b*) is a diagram illustrating one of the left and right halves of the brassiere in accordance with a second modified example of the first embodiment of the present invention. The brassiere 1B in accordance with the second modified example differs from the first embodiment in that it comprises a cup part 10B in place of the cup part 10 in the brassiere 1. Except for this point, the brassiere 1B of the second modified example is constructed as with the brassiere 1 of the first embodiment.

The cup part 10B differs from the cup part 10 in that each part of its middle cup portion 14B has a width different from that of the middle cup portion 14. Specifically, the width of the middle cup portion 14B gradually increases from the front center side end portion 14*f* to the outer side end portion 14*s*. That is, in the middle cup portion 14B, the width Ws of the outer side end portion 14*s* is greater than the width We of the center portion, which is greater than the width Wf of the front center side end portion 14*f*. The front center side end portion 14*f* in the middle cup portion 14B is preferably in contact with the front center side edge 10*lf* of the lower portion of the cup part 10B, and the present invention encompasses a mode in which the width Wf is as narrow as possible so as to become a point.

Except for the above, the cup part 10B is constructed as with the cup part 10. That is, the cup part 10B has an upper cup portion 12B, a middle cup portion 14B, and a lower cup portion 16B, while the middle cup portion 14B is sewed between the upper and lower cup portions 12B, 16B. The middle cup portion 14B is arranged such that the bust top T is designed to be positioned at the boundary between the upper and middle cup portions 12B, 14B and, when worn, is located at the boundary or in the middle cup portion 14B. The middle cup portion 14B is formed into a band extending substantially linearly from the front center side edge 10*lf* of the lower portion of the cup part 10B to the edge 10*s* of the side portion thereof through near the bust top T.

The brassiere 1B of the second modified example has advantages similar to those of the brassiere 1 of the first embodiment.

Widening the width Ws of the outer side end portion 14*s* of the middle cup portion 14B as in this structure enables the cup part to fit the round form of the bust favorably, thereby enhancing the bust shaping property. It can also enhance the gathering effect produced by the middle cup portion.

Third Modified Example of First Embodiment

FIG. 2(*c*) is a diagram illustrating one of the left and right halves of the brassiere in accordance with a third modified example of the first embodiment of the present invention. The brassiere 1C in accordance with the third modified example differs from the first embodiment in that it comprises a cup part 10C in place of the cup part 10 in the brassiere 1. Except for this point, the brassiere 1C of the third modified example is constructed as with the brassiere 1 of the first embodiment.

The cup part 10C differs from the cup part 10 in that each part of its middle cup portion 14C has a width different from that of the middle cup portion 14. Specifically, the width of the middle cup portion 14C gradually increases from the front center side end portion 14*f* and the outer side end portion 14*s* to its center portion. That is, in the middle cup portion 14C, the width Wc of the center portion is greater than each of the width Wf of the front center side end portion 14*f* and the width Ws of the outer side end portion 14*s*. The front center side end portion 14*f* and outer side end portion 14*s* in the middle cup portion 14C are preferably in contact with the front center side edge 10*lf* of the lower portion and the edge 10*s* of the side portion of the cup part 10C, respectively, and the present invention encompasses a mode in which the widths Wf, Ws are as narrow as possible so as to become points.

Except for the above, the cup part 10C is constructed as with the cup part 10. That is, the cup part 10C has an upper cup portion 12C, a middle cup portion 14C, and a lower cup portion 16C, while the middle cup portion 14C is sewed between the upper and lower cup portions 12C, 16C. The middle cup portion 14C is arranged such that the bust top T is designed to be positioned at the boundary between the upper and middle cup portions 12C, 14C and, when worn, is located at the boundary or in the middle cup portion 14C. The middle cup portion 14C is formed into a band extending substantially linearly from the front center side edge 10*lf* of the lower portion of the cup part 10C to the edge 10*s* of the side portion thereof through near the bust top T.

The brassiere 1C of the third modified example has advantages similar to those of the brassiere 1 of the first embodiment.

Fourth Modified Example of First Embodiment

Figure 3:
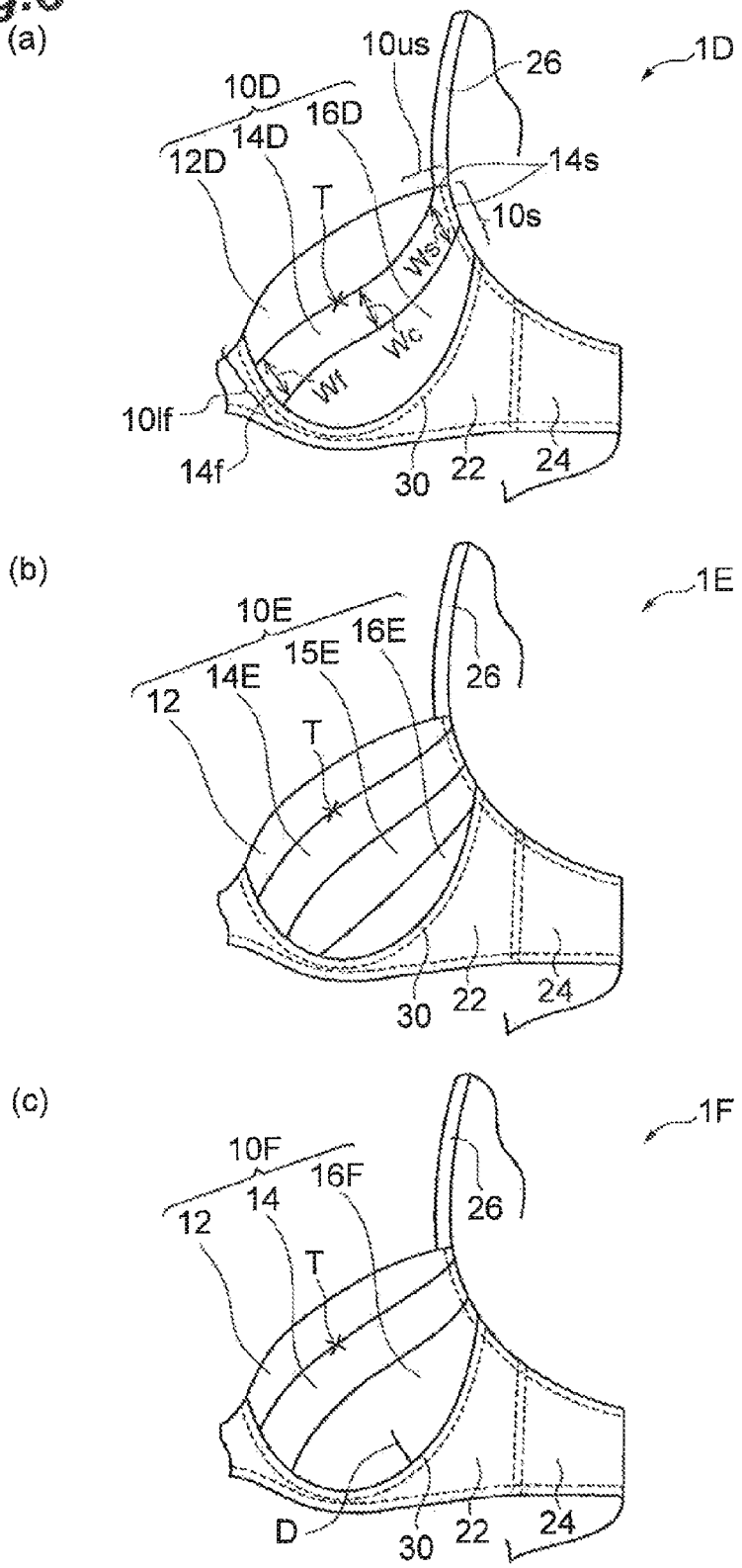
FIGS. 3(*a*) to 3(*c*) are diagrams illustrating one of the left and right halves of respective brassieres in accordance with fourth, fifth, and sixth modified examples of the first embodiment of the present invention.

FIG. 3(*a*) is a diagram illustrating one of the left and right halves of the brassiere in accordance with a fourth modified example of the first embodiment of the present invention. The brassiere 1D in accordance with the fourth modified example differs from the first embodiment in that it comprises a cup part 10D in place of the cup part 10 in the brassiere 1. Except for this point, the brassiere 1D of the fourth modified example is constructed as with the brassiere 1 of the first embodiment.

The cup part 10D differs from the cup part 10 in that the position of the outer side end portion 14*s* in its middle cup portion 14D is different from that in the middle cup portion 14. Specifically, the middle cup portion 14D is formed into a band extending substantially linearly from the front center side edge 10*lf* of the lower portion of the cup part 10D to the edge 10*s* of the side portion and the outer side edge 10*us* of the upper portion thereof through near the bust top T.

Except for the above, the cup part 10D is constructed as with the cup part 10. That is, the cup part 10D has an upper cup portion 12D, a middle cup portion 14D, and a lower cup portion 16D, while the middle cup portion 14D is sewed between the upper and lower cup portions 12D, 16D. The middle cup portion 14D is arranged such that the bust top T is designed to be positioned at the boundary between the upper and middle cup portions 12D, 14D and, when worn, is located at the boundary or in the middle cup portion 14D. The middle cup portion 14D has substantially the same width from the front center side end portion 14*f* to the outer side end portion 14*s*.

The brassiere 1D of the fourth modified example has advantages similar to those of the brassiere 1 of the first embodiment.

Fifth Modified Example of First Embodiment

FIG. 3(*b*) is a diagram illustrating one of the left and right halves of the brassiere in accordance with a fifth modified example of the first embodiment of the present invention. The brassiere 1E in accordance with the fifth modified example differs from the first embodiment in that it comprises a cup part 10E in place of the cup part 10 in the brassiere 1. Except for this point, the brassiere 1E of the fifth modified example is constructed as with the brassiere 1 of the first embodiment.

The cup part 10E differs from the cup part 10 in that it has middle cup portions 14E, 15E in place of the middle cup portion 14. That is, in the cup part 10E, its middle cup portion is formed by sewing the middle cup portions 14E, 15E to each other. A lower cup portion 16E is sewed to the lower side of the middle cup portion 15E. Thus, the cup part 10E forms a transversal four-sheet-sewed cup part having transversal seams. Except for the above, the cup part 10E is constructed as with the cup part 10.

The brassiere 1E of the fifth modified example has advantages similar to those of the brassiere 1 of the first embodiment.

Since the middle cup portions 14E, 15E constitute a transversally sewed structure, the brassiere 1E of the fifth modified example can fit the round form of the bust better, thereby further enhancing the bust shaping property. The higher bust shaping property and the higher fitness of the cup part for the bust enable the cup part to rest stably on the bust, thereby inhibiting the cup part from shifting from the bust, in particular, the upper portion of the cup part from floating or biting that occurs as a result of the wearer's movement.

Sixth Modified Example of First Embodiment

FIG. 3(*c*) is a diagram illustrating one of the left and right halves of the brassiere in accordance with a sixth modified example of the first embodiment of the present invention. The brassiere 1F in accordance with the sixth modified example differs from the first embodiment in that it comprises a cup part 10F in place of the cup part 10 in the brassiere 1. Except for this point, the brassiere 1F of the sixth modified example is constructed as with the brassiere 1 of the first embodiment.

The cup part 10F differs from the cup part 10 in that it has a lower cup portion 16F in place of the lower cup portion 16. The lower cup portion 16F differs from the lower cup portion 16 in that a dart D is formed on the lower portion side of the cup part 10F. Except for the above, the cup part 10F is constructed as with the cup part 10.

The brassiere 1F of the sixth modified example has advantages similar to those of the brassiere 1 of the first embodiment.

In the brassiere 1F of the sixth modified example, the lower cup portion 16F can fit the round form of the lower portion of the bust better, thereby further enhancing the bust shaping property. The higher bust shaping property and the higher fitness of the cup part for the bust enable the cup part to rest stably on the bust, thereby inhibiting the cup part from shifting from the bust, in particular, the upper portion of the cup part from floating or biting that occurs as a result of the wearer's movement.

Second Embodiment

Figure 4:
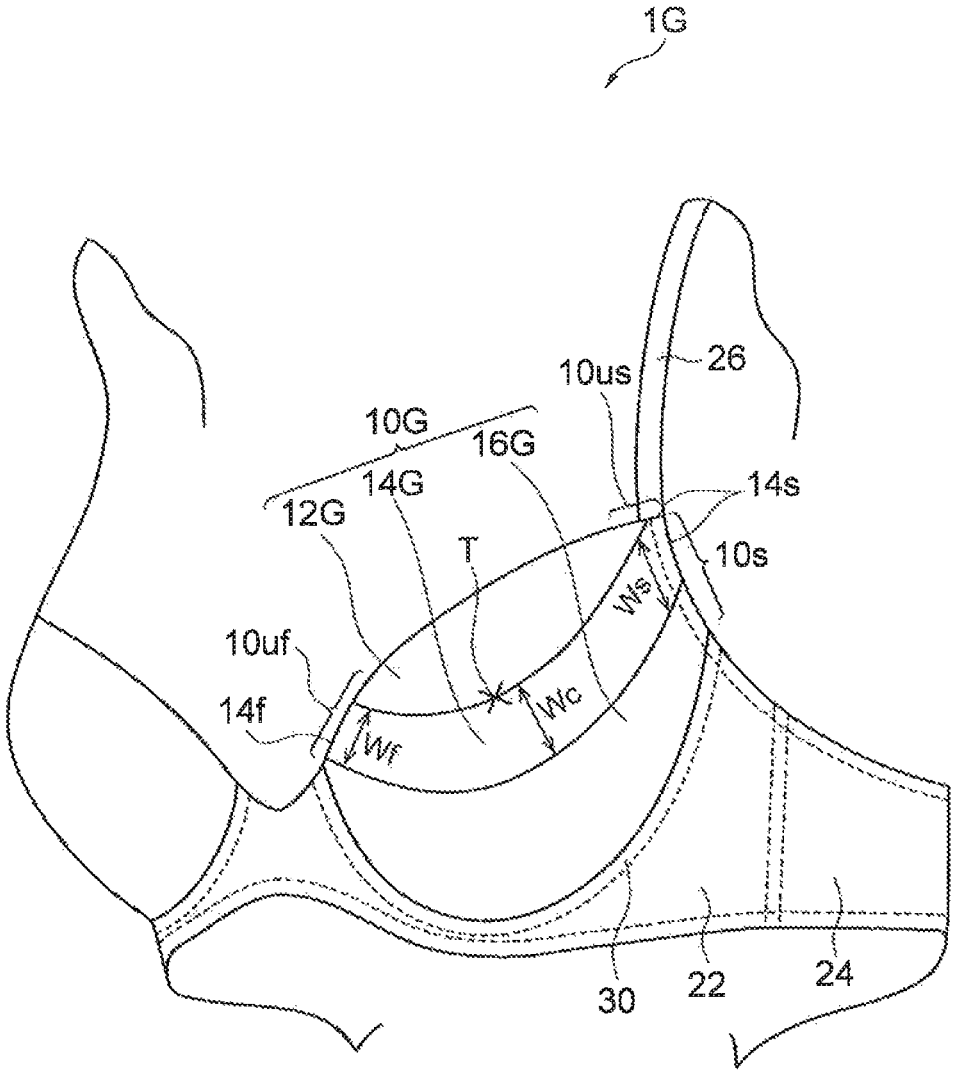
FIG. 4 is a perspective view illustrating the brassiere in accordance with a second embodiment of the present invention.

FIG. 4 is a perspective view illustrating the brassiere in accordance with the second embodiment of the present invention. The brassiere 1G of the second embodiment differs from the brassiere 1 of the first embodiment in that it comprises a cup part 10G in place of the cup part 10 in the brassiere 1. Except for this point, the brassiere 1G of the second embodiment is constructed as with the brassiere 1 of the first embodiment.

The cup part 10G differs from the cup part 10 mainly in that the mode of its middle cup portion 14G is different from that of the middle cup portion 14. Specifically, the middle cup portion 14G is formed into a band extending substantially like an arc from the front center side edge 10*uf* of the upper portion of the cup part 10G to the edge 10*s* of the side portion and the outer side edge 10*us* of the upper portion thereof through near the bust top T. The middle cup portion 14G has substantially the same width from the front center side end portion 14*f* to the outer side end portion 14*s*. That is, in the middle cup portion 14G, each of the width Wf of the front center side end portion 14*f* and the width Ws of the outer side end portion 14*s* is substantially equal to the width Wc of the center portion. Thus, the cup part 10G also forms a transversal three-sheet-sewed cup part having transversal seams.

The cup part 10G also differs from the cup part 10 in terms of the bust push-up force produced by each portion. Specifically, the lower cup portion 16G is thicker than the middle cup portion 14G, which is thicker than the upper cup portion 120. This makes the bust push-up force of the lower cup portion 16G further stronger than that of the middle cup portion 14G, and the bust push-up force of the middle cup portion 14G further stronger than that of the upper cup portion 12G.

Except for the above, the cup part 100 is constructed as with the cup part 10. That is, the cup part 100 has an upper cup portion 12G, a middle cup portion 14G, and a lower cup portion 16G, while the middle cup portion 14G is sewed between the upper and lower cup portions 12G, 16G. The middle cup portion 140 is arranged such that the bust top T is designed to be positioned at the boundary between the upper and middle cup portions 12G, 14G and, when worn, is located at the boundary or in the middle cup portion 14G.

Since the cup part 10G is a transversal three-sheet-sewed cup part constituted by the upper, middle, and lower cup portions 12G, 14G, 16G, the brassiere 1G in accordance with the second embodiment can enhance the fitness of the cup part 10G for the bust having a round form, thereby enhancing the bust shaping property. In particular, it can deepen the cleavage between the left and right breasts and round the bust tops.

In particular, the brassiere 1G of the second embodiment is suitable for sagging busts, which are often seen in females in their later thirties and early forties and become softer with age.

For enhancing the bust shaping (gathering and raising) property for this kind of soft sagging busts, pushing up the vicinity of the outer side of the lower portion is effective. In the brassiere 1G of the second embodiment, the push-up force of the cup part 10G increases in ascending order of the upper, middle, and lower cup portions 12G, 14G, 16G, whereby the lower and middle cup portions 16G, 14G can push up the sagging bust. Hence, the brassiere 1G of the second embodiment can enhance the shaping property for sagging busts which become softer with age. Further, the upper, middle, and lower cup portions 12G, 14G 16G are substantially formed like an arc and thus can shape the pushed-up bust into a round form and fit the shaped round bust.

Because of the high bust shaping property and the high fitness of the cup part 10G for the bust as mentioned above, the brassiere 1G of the second embodiment also enables the cup part 10G to rest stably on the bust, thereby inhibiting the cup part 10G from shifting from the bust, in particular, the upper side of the cup part 10G from floating or biting that occurs as a result of the wearer's movement.

Widening the middle cup portion 14G from the front center side end portion 14*f* to the outer side end portion 14*s* as in this structure enables the cup part 10G to fit the round form of the bust favorably, thereby enhancing the bust shaping property. It can also enhance the gathering effect produced by the middle cup portion 14G. Further, when sewing the middle cup portion 14G, the front center side end portion 14*f* and outer side end portion 14*s* of the middle cup portion 14G are easier to support, which facilitates a manufacture process.

First Modified Example of Second Embodiment

Figure 5:
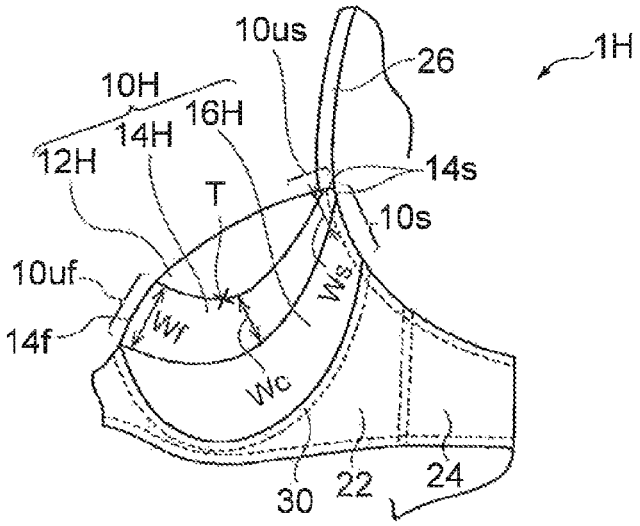
FIGS. 5(*a*) to 5(*c*) are diagrams illustrating one of the left and right halves of respective brassieres in accordance with first, second, and third modified examples of the second embodiment of the present invention.
Figure 5:
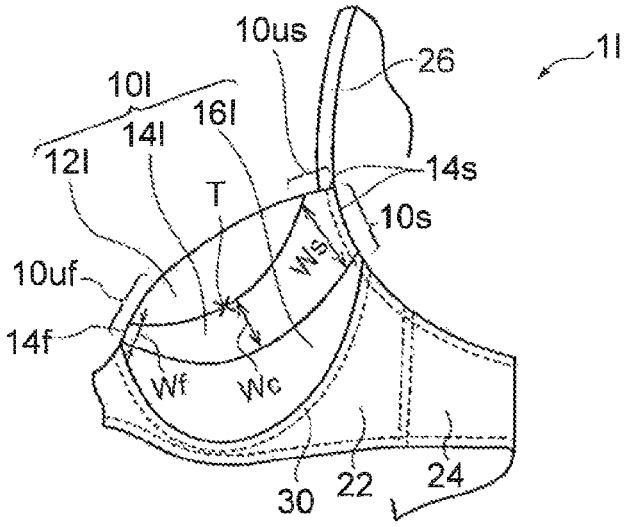
Figure 5:
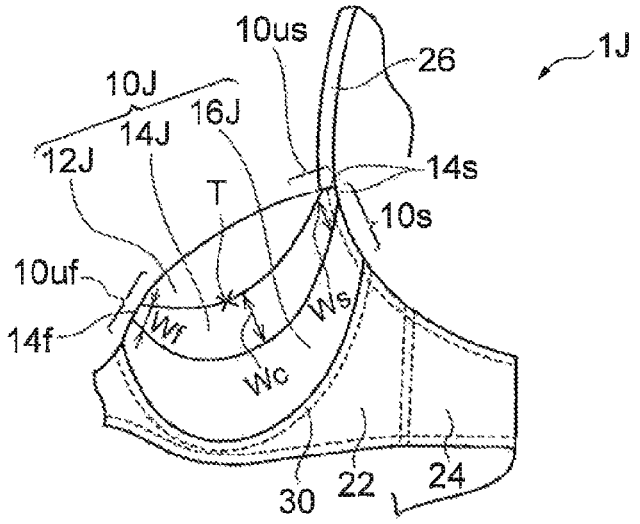

FIG. 5(*a*) is a diagram illustrating one of the left and right halves of the brassiere in accordance with a first modified example of the second embodiment of the present invention. The brassiere 1H in accordance with the first modified example differs from the second embodiment in that it comprises a cup part 10H in place of the cup part 10G in the brassiere 1G. Except for this point, the brassiere 1H of the first modified example is constructed as with the brassiere 1G of the second embodiment.

The cup part 10H differs from the cup part 10G in that each part of its middle cup portion 14H has a width different from that of the middle cup portion 14G. Specifically, the width of the middle cup portion 14H gradually increases from the outer side end portion 14*s* to the front center side end portion 14*f*. That is, in the middle cup portion 14H, the width Wf of the front center side end portion 14*f* is greater than the width Wc of the center portion, which is greater than the width. Ws of the outer side end portion 14*s*. The outer side end portion 14*s* in the middle cup portion 14H is preferably in contact with the edge 10*s* of the side portion or the outer side edge 10*us* of the upper portion of the cup part 10H, and the present invention encompasses a mode in which the width Ws is as narrow as possible so as to become a point.

Except for the above, the cup part 10H is constructed as with the cup part 10G. That is, the cup part 10H has an upper cup portion 12H, a middle cup portion 14H, and a lower cup portion 16H, while the middle cup portion 14H is sewed between the upper and lower cup portions 12H, 16H. The middle cup portion 14H is arranged such that the bust top T is designed to be positioned at the boundary between the upper and middle cup portions 12H, 14H and, when worn, is located at the boundary or in the middle cup portion 14H. The middle cup portion 14H is formed into a band extending substantially like an arc from the front center side edge 10*uf* of the upper portion of the cup part 10H to the edge 10*s* of the side portion and the outer side edge 10*us* of the upper portion thereof through near the bust top T.

The brassiere 1H of the first modified example has advantages similar to those of the brassiere 1G of the second embodiment.

Widening the width Wf of the front center side end portion 14*f* of the middle cup portion 14H as in this structure enables the cup part to fit the round form of the bust favorably, thereby enhancing the bust shaping property.

Second Modified Example of Second Embodiment

FIG. 5(*b*) is a diagram illustrating one of the left and right halves of the brassiere in accordance with a second modified example of the second embodiment of the present invention. The brassiere 1I in accordance with the second modified example differs from the second embodiment in that it comprises a cup part 10I in place of the cup part 10G in the brassiere 1G. Except for this point, the brassiere 1I of the second modified example is constructed as with the brassiere 1G of the second embodiment.

The cup part 10I differs from the cup part 10G in that each part of its middle cup portion 14I has a width different from that of the middle cup portion 14G. Specifically, the width of the middle cup portion 14I gradually increases from the front center side end portion 14*f* to the outer side end portion 14*s*. That is, in the middle cup portion 14I, the width Ws of the outer side end portion 14*s* is greater than the width Wc of the center portion, which is greater than the width Wf of the front center side end portion 14*f*. The front center side end portion 14*f* in the middle cup portion 14I is preferably in contact with the front center side edge 10*uf* of the upper portion of the cup part 10I, and the present invention encompasses a mode in which the width Wf is as narrow as possible so as to become a point.

Except for the above, the cup part 10I is constructed as with the cup part 10G. That is, the cup part 10I has an upper cup portion 12I, a middle cup portion 14I, and a lower cup portion 16I, while the middle cup portion 14I is sewed between the upper and lower cup portions 12I, 16I. The middle cup portion 14I is arranged such that the bust top T is designed to be positioned at the boundary between the upper and middle cup portions 12I, 14I and, when worn, is located at the boundary or in the middle cup portion 14I. The middle cup portion 14I is formed into a band extending substantially like an arc from the front center side edge 10*uf* of the upper portion of the cup part 10I to the edge 10*s* of the side portion and the outer side edge 10*us* of the upper portion thereof through near the bust top T.

The brassiere 1I of the second modified example has advantages similar to those of the brassiere 1G of the second embodiment.

Widening the width Ws of the outer side end portion 14*s* of the middle cup portion 14I as in this structure enables the cup part to fit the round form of the bust favorably, thereby enhancing the bust shaping property. It can also enhance the gathering effect produced by the middle cup portion.

Third Modified Example of Second Embodiment

FIG. 5(*c*) is a diagram illustrating one of the left and right halves of the brassiere in accordance with a third modified example of the second embodiment of the present invention. The brassiere 1J in accordance with the third modified example differs from the second embodiment in that it comprises a cup part 10J in place of the cup part 10G in the brassiere 1G. Except for this point, the brassiere 1J of the third modified example is constructed as with the brassiere 1G of the second embodiment.

The cup part 10J differs from the cup part 10G in that each part of its middle cup portion 14J has a width different from that of the middle cup portion 14G. Specifically, the width of the middle cup portion 14J gradually increases from the front center side end portion 14*f* and the outer side end portion 14*s* to its center portion. That is, in the middle cup portion 14J, the width We of the center portion is greater than any of the width Wf of the front center side end portion 14*f* and the width Ws of the outer side end portion 14*s*. The front center side end portion 14*f* and outer side end portion 14*s* in the middle cup portion 14J are preferably in contact with the front center side edge 10*uf* of the upper portion, the edge 10*s* of the upper portion or the outer side edge 10*us* of the upper portion of the cup part 10J, respectively, and the present invention encompasses a mode in which the widths Wf, Ws are as narrow as possible so as to become points.

Except for the above, the cup part 10J is constructed as with the cup part 10G. That is, the cup part 103 has an upper cup portion 12J, a middle cup portion 14J, and a lower cup portion 16J, while the middle cup portion 14J is sewed between the upper and lower cup portions 12J, 16J. The middle cup portion 14J is arranged such that the bust top T is designed to be positioned at the boundary between the upper and middle cup portions 12J, 14J and, when worn, is located at the boundary or in the middle cup portion 14J. The middle cup portion 14J is formed into a band extending substantially like an arc from the front center side edge 10*uf* of the upper portion of the cup part 105 to the edge 10*s* of side portion and the outer side edge 10*us* of the upper portion thereof through near the bust top T.

The brassiere 1J of the third modified example has advantages similar to those of the brassiere 1G of the second embodiment.

Fourth Modified Example of Second Embodiment

Figure 6:
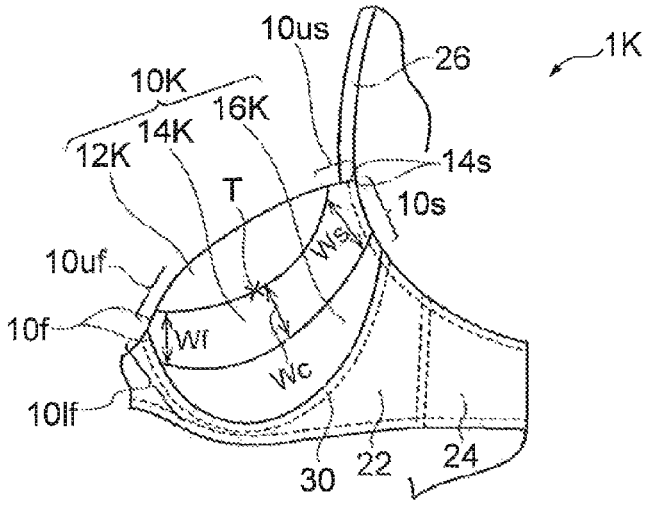
FIGS. 6(*a*) to 6(*c*) are diagrams illustrating one of the left and right halves of respective brassieres in accordance with fourth, fifth, and sixth modified examples of the second embodiment of the present invention.
Figure 6:
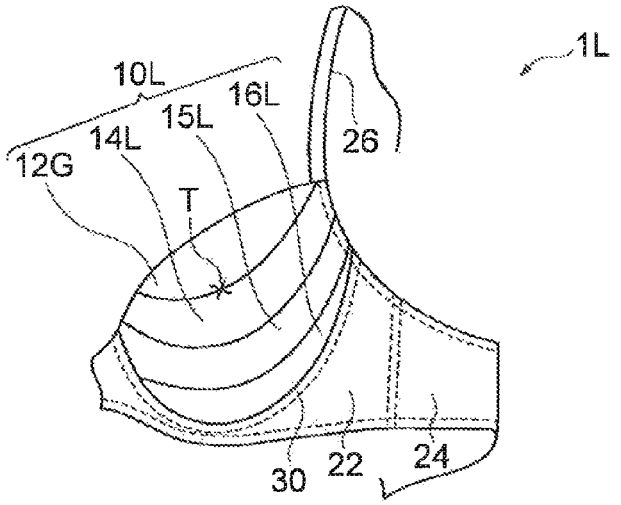
Figure 6:
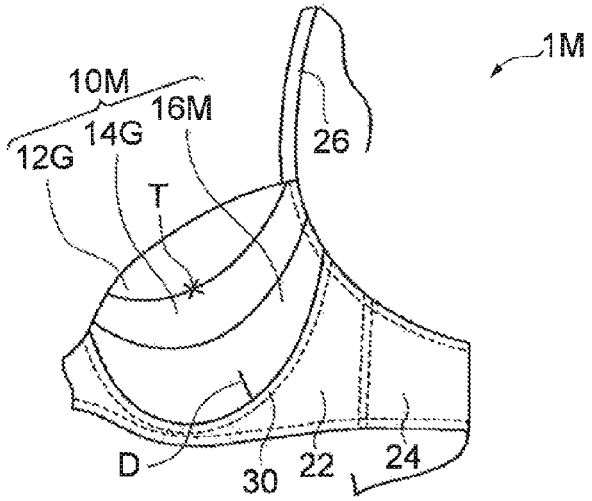

FIG. 6(*a*) is a diagram illustrating one of the left and right halves of the brassiere in accordance with a fourth modified example of the second embodiment of the present invention. The brassiere 1K in accordance with the fourth modified example differs from the second embodiment in that it comprises a cup part 10K in place of the cup part 10G in the brassiere 1G. Except for this point, the brassiere 1K of the fourth modified example is constructed as with the brassiere 1G of the second embodiment.

The cup part 10K differs from the cup part 10G in that the positions of the front center side end portion 14*f* and outer side end portion 14*s* in its middle cup portion 14K are different from those in the middle cup portion 14. Specifically, the middle cup portion 14K is formed into a band extending substantially like an arc from the front center side edge 10*uf* of the upper portion and the front center side edge 10*lf* of the lower portion of the cup part 10K to the edge 10*s* of the side portion and the outer side edge 10*us* of the upper portion thereof through near the bust top T.

Except for the above, the cup part 10K is constructed as with the cup part 10G. That is, the cup part 10K has an upper cup portion 12K, a middle cup portion 14K, and a lower cup portion 16K, while the middle cup portion 14K is sewed between the upper and lower cup portions 12K, 16K. The middle cup portion 14K is arranged such that the bust top T is designed to be positioned at the boundary between the upper and middle cup portions 12K, 14K and, when worn, is located at the boundary or in the middle cup portion 14K. The middle cup portion 14K has substantially the same width from the front center side end portion 14*f* to the outer side end portion 14*s*.

The brassiere 1K of the fourth modified example has advantages similar to those of the brassiere 1G of the second embodiment.

Fifth Modified Example of Second Embodiment

FIG. 6(*b*) is a diagram illustrating one of the left and right halves of the brassiere in accordance with a fifth modified example of the second embodiment of the present invention. The brassiere 1L in accordance with the fifth modified example differs from the second embodiment in that it comprises a cup part 10L in place of the cup part 10G in the brassiere 1G. Except for this point, the brassiere 1L of the fifth modified example is constructed as with the brassiere 1G of the second embodiment.

The cup part 10L differs from the cup part 10G in that it has middle cup portions 14L, 15L in place of the middle cup portion 14G. That is, in the cup part 10L, its middle cup portion is formed by sewing the middle cup portions 14L, 15L to each other. A lower cup portion 16L is sewed to the lower side of the middle cup portion 15L. Thus, the cup part 10L forms a transversal four-sheet-sewed cup part having transversal seams. Except for the above, the cup part 10L is constructed as with the cup part 10G.

The brassiere 1L of the fifth modified example has advantages similar to those of the brassiere 1G of the second embodiment.

Since the middle cup portions 14L, 15L constitute a transversally sewed structure, the brassiere 1L of the fifth modified example can fit the round form of the bust better, thereby further enhancing the bust shaping property. The higher bust shaping property and the higher fitness of the cup part for the bust enable the cup part to rest stably on the bust, thereby inhibiting the cup part from shifting from the bust, in particular, the upper portion of the cup part from floating or biting that occurs as a result of the wearer's movement.

Sixth Modified Example of Second Embodiment

FIG. 6(*c*) is a diagram illustrating one of the left and right halves of the brassiere in accordance with a sixth modified example of the second embodiment of the present invention. The brassiere 1M in accordance with the sixth modified example differs from the second embodiment in that it comprises a cup part 10M in place of the cup part 10G in the brassiere 1G. Except for this point, the brassiere 1M of the sixth modified example is constructed as with the brassiere 1G of the second embodiment.

The cup part 10M differs from the cup part 10G in that it has a lower cup portion 16M in place of the lower cup portion 16G. The lower cup portion 16M differs from the lower cup portion 16G in that a dart D is formed on the lower portion side of the cup part 10M. Except for the above, the cup part 10M is constructed as with the cup part 10G.

The brassiere 1M of the sixth modified example has advantages similar to those of the brassiere 1G of the second embodiment.

In the brassiere 1M of the sixth modified example, the lower cup portion 16M can fit the round form of the lower portion of the bust better, thereby further enhancing the bust shaping property. The higher bust shaping property and the higher fitness of the cup part for the bust enable the cup part to rest stably on the bust, thereby inhibiting the cup part from shifting from the bust, in particular, the upper portion of the cup part from floating or biting that occurs as a result of the wearer's movement.

Without being limited to the above-mentioned embodiments and modified examples, the present invention can be modified in various ways. For example, while the embodiments and modified examples exemplify the transversal three- and four-sheet-sewed cup parts 10, 10A to 10M, five or more sheets of fabrics may be sewed so as to form a cup part having transversal seams.

While the sixth modified examples of the first and second embodiments illustrate an example in which each of the lower cup portions 16F, 16M has one dart in a substantially vertical direction on the lower portion side of its corresponding cup part 10F, 10M, the lower cup portion may have two or more darts. The lower cup portion may also be formed by sewing two or more sheets of fabrics together so as to have a vertical seam line instead of producing a dart.

While the embodiments and modified examples illustrate examples in which the middle cup portions 14, 14A to 14E, 15E, 14G to 14L, 15L extend from the front center side edge 10*lf* of the lower portion or the front center side edge 10*uf* of the upper portion of the cup parts 10, 10A to 10M to the edge 10*s* of the side portion or the outer side edge 10*us* of the upper portion thereof, the middle cap portion may extend from the front center side edge of the lower portion or the front center side edge of the upper portion of the cup part to the outer side edge of the lower portion.

The bust push-up force, which is regulated by the thickness of fabrics of the upper cup portions 12, 12A to 12D, 12G to 12K, middle cup portions 14, 14A to 14E, 15E, 14G to 14L, 15L and lower cup portions 16, 16A to 16M in the embodiments and modified examples, can also be adjusted by the elasticity of fabrics and the like.

While the embodiments and modified examples illustrate the cup parts 10, 10A to 10M made of fabrics, characteristic features of the embodiments and modified examples are also applicable to molded cup parts.

The embodiments and modified examples illustrate brassieres loaded with the underwire 30, but the characteristic features of the embodiments and modified examples are also applicable to wirefree brassieres without underwire as mentioned above.

While the embodiments and modified examples illustrate brassieres equipped with the base part 22, the characteristic features of the embodiments and modified examples are also applicable to brassieres with no base parts as mentioned above.

The embodiments and modified examples illustrate brassieres of a type in which the rear ends of the back belt parts 24 are fastened to each other with hooks and the like, but the characteristic features of the embodiments and modified examples are also applicable to front close brassieres in which the base part 22 is separated at the front center into left and right halves which are fastened to each other with hooks and the like.

While the embodiments and modified examples illustrate brassieres each having a transversal three-sheet-sewed cup part comprising upper, middle, and lower cup portions, the characteristic features of the embodiments and modified examples are also applicable to brassieres of a type in which the front side of the cup part is provided with a lace fabric for decoration and those of a type in which the rear side of the cup part is equipped with a pad receiving portion (pad inserting portion) adapted to insert a pad therein.

The characteristic features of the embodiments and modified examples are applicable to all types of brassieres such as full cup, ¾ cup, and ½ cup brassieres.

The characteristic, features of the embodiments and modified examples are applicable not only to brassieres, but also to all of garments such as bra slips, bra camisoles, bodysuits, teddies with cups, and swimsuits that are equipped with cup parts.

What is claimed is:

1. A garment when worn having a cup part for covering a wearer's bust top including a nipple;

wherein the cup part has an upper portion, a lower portion, and a side portion;

an upper cup portion also having a lower portion of the upper cup portion, a lower cup portion also having a upper portion of the lower cup portion, and a middle cup portion also having a upper portion of the middle cup portion and a lower portion of the middle cup portion, with the middle cup portion sewn between the upper cup portion and the lower cup portion such that the lower portion of the upper cup portion and the upper portion of the middle cup portion are sewn to each other, and the lower portion of the middle cup portion and the upper portion of the lower cup portion are sewn to each other, providing a transversal seam between the upper cup portion and the middle cup portion, and a transversal seam between the middle cup portion and the lower cup portion, wherein the upper cup portion is not sewn to the lower cup portion; and wherein the middle cup portion is arranged such that the bust top is located at the transversal seam between the upper cup portion and the middle cup portion, or in the middle cup portion, and, the middle cup portion extends from a front center side edge of the lower portion of the cup to an outer side edge of the lower portion of the cup, an edge of the side portion of the cup, or an outer side edge of the upper portion of the cup;

and, the upper cup portion is thinner than the middle cup portion or the lower cup portion.

2. A garment having a cup part according to claim 1, wherein the middle cup portion has a front center side end portion toward an area between breasts of the wearer, and an outer side end portion toward a shoulder of the wearer, and the front center side end portion has a width greater than that of the outer side end portion.

3. A garment having a cup part according to claim 1, wherein the middle cup portion has a front center side end portion toward an area between breasts of the wearer, and an outer side end portion toward a shoulder of the wearer, and the outer side end portion has a width greater than that of the front center side end portion.

4. A garment having a cup part according to claim 1, wherein the middle cup portion has a front center side end portion toward an area between breasts of the wearer, and an outer side end portion toward a shoulder of the wearer, and each of the front center side end portion and the outer side end portion has a width equal to that of a center portion.

* * * * *